US012365531B2

(12) United States Patent
Mills

(10) Patent No.: US 12,365,531 B2
(45) Date of Patent: Jul. 22, 2025

(54) BANDED CONTAINER FOR FRUITS AND PRODUCE

(71) Applicant: JPM SERVICES, INC., Selah, WA (US)

(72) Inventor: Joseph P. Mills, Yakima, WA (US)

(73) Assignee: JPM Services, Inc., Yakima, WA (US)

( * ) Notice: Subject to any disclaimer, the term of this patent is extended or adjusted under 35 U.S.C. 154(b) by 0 days.

(21) Appl. No.: 17/698,809

(22) Filed: Mar. 18, 2022

(65) Prior Publication Data

US 2023/0294910 A1 Sep. 21, 2023

(51) Int. Cl.

| | |
|---|---|
| ***B65D 85/34*** | (2006.01) |
| ***B65D 71/02*** | (2006.01) |
| ***B65D 71/38*** | (2006.01) |

(52) U.S. Cl.

CPC ..... *B65D 85/34* (2013.01); *B65D 71/02* (2013.01); *B65D 71/38* (2013.01)

(58) Field of Classification Search

CPC ..... B65D 85/34; B65D 71/02; B65D 71/38; B65D 51/1655; B65D 2401/50; B65D 83/0472; B65D 43/168; B65D 55/089; B65D 63/00; B65D 53/00; B65D 67/00; B65D 67/02; B65D 5/3692; B65D 5/4283; B65D 9/38; B65D 45/32; B65D 25/102; B65D 55/0818; B65D 73/0014

USPC ..... 206/560

See application file for complete search history.

(56) References Cited

U.S. PATENT DOCUMENTS

| | | | | |
|---|---|---|---|---|
| 191,712 | A | 6/1877 | Pickens | |
| 343,757 | A | 6/1886 | Cole | |
| 1,330,382 | A * | 2/1920 | Miller | B65D 9/38 217/12 R |
| 1,360,688 | A * | 11/1920 | Romig | B65D 55/06 217/89 |
| 1,555,054 | A * | 9/1925 | Berkowitz | B65D 5/3607 229/110 |
| 1,725,526 | A * | 8/1929 | Kondolf | B65D 5/4283 53/145 |
| 1,725,527 | A | 8/1929 | Kondolf | |
| 2,896,808 | A * | 7/1959 | Papy | B65D 9/18 217/69 |
| 3,370,779 | A | 2/1968 | Cole | |
| 3,901,432 | A * | 8/1975 | Lancaster | B65D 5/4283 229/117.02 |

(Continued)

*Primary Examiner* — Ernesto A Grano
*Assistant Examiner* — Symren K Sanghera
(74) *Attorney, Agent, or Firm* — Svendsen Legal, LLC

(57) ABSTRACT

A container for produce, and specifically for fruits such as apples that provides a secure and well ventilated shipping enclosure, allowing the purchaser to visually inspect the contents, while preventing the enclosed produce from being removed or dropping out of the container. The container is preferably constructed from bio-degradeable materials such as a kraft paper or cardboard, and includes a bottom tray into which the produce is placed. A top tray is placed over the produce contained in the bottom tray, with trays including pairs of "corner-holes" near the four corners of both trays, each pair connected by corner slots. An elastic band is then placed around both the top tray and the bottom tray, received into each set of corner holes and held within each corner slot. Preferably two elastic band are used, one located proximate to each end of the container.

13 Claims, 10 Drawing Sheets

(56) References Cited

U.S. PATENT DOCUMENTS

| | | | | |
|---|---|---|---|---|
| 3,949,933 | A | 4/1976 | Giambrone et al. | |
| 5,765,748 | A | 6/1998 | Chen | |
| 7,726,552 | B2 | 6/2010 | Chadima | |
| 7,845,595 | B2 | 12/2010 | Goddard | |
| 8,887,935 | B2 | 11/2014 | Zemitis et al. | |
| 9,138,604 | B2 | 9/2015 | Cleary et al. | |
| 2006/0283733 | A1* | 12/2006 | Masa | B65D 5/4283 206/278 |
| 2007/0023428 | A1* | 2/2007 | Wambold | B65D 43/0204 220/4.21 |
| 2007/0056980 | A1* | 3/2007 | Sambrailo | B65D 43/162 220/592.01 |
| 2008/0302808 | A1* | 12/2008 | Maxwell | B65D 5/4216 220/810 |
| 2012/0292813 | A1* | 11/2012 | Middleton | B29C 45/14467 264/320 |
| 2014/0116904 | A1* | 5/2014 | Fosbury | B65D 5/248 206/281 |
| 2015/0069208 | A1* | 3/2015 | Wynnick | F25D 23/10 248/674 |
| 2018/0016064 | A1* | 1/2018 | Lam | B65D 43/162 |
| 2021/0061531 | A1* | 3/2021 | Pinkstone | B65D 43/0256 |

* cited by examiner

BANDED CONTAINER FOR FRUITS AND PRODUCE

TECHNICAL FIELD

The present disclosure relates to a banded container for fruits and produce.

BACKGROUND

Development of the disclosed banded container was motivated by existing point-of-sale types of produce containers and cartons, in response to changing market driven requirements primarily due to the adverse environmental impacts of plastic packaging materials. There is a need for containers made of bio-degradable and recyclable materials that also protect the contents of the container, while providing a point of sale display that is attractive to the consumer or purchaser. The following disclosure of the present invention will be understood by reference to the following detailed description, taken in conjunction with the accompanying drawings

BRIEF DESCRIPTION OF DRAWINGS

Exemplary embodiments of the technology will become more fully apparent from the following description and appended claims, taken in conjunction with the accompanying drawings. Understanding that these drawings depict only exemplary embodiments and are, therefore, not to be considered limiting of the scope of the technology, the exemplary embodiments will be described with additional specificity and detail through use of the accompanying drawings in which:

Figure 1:
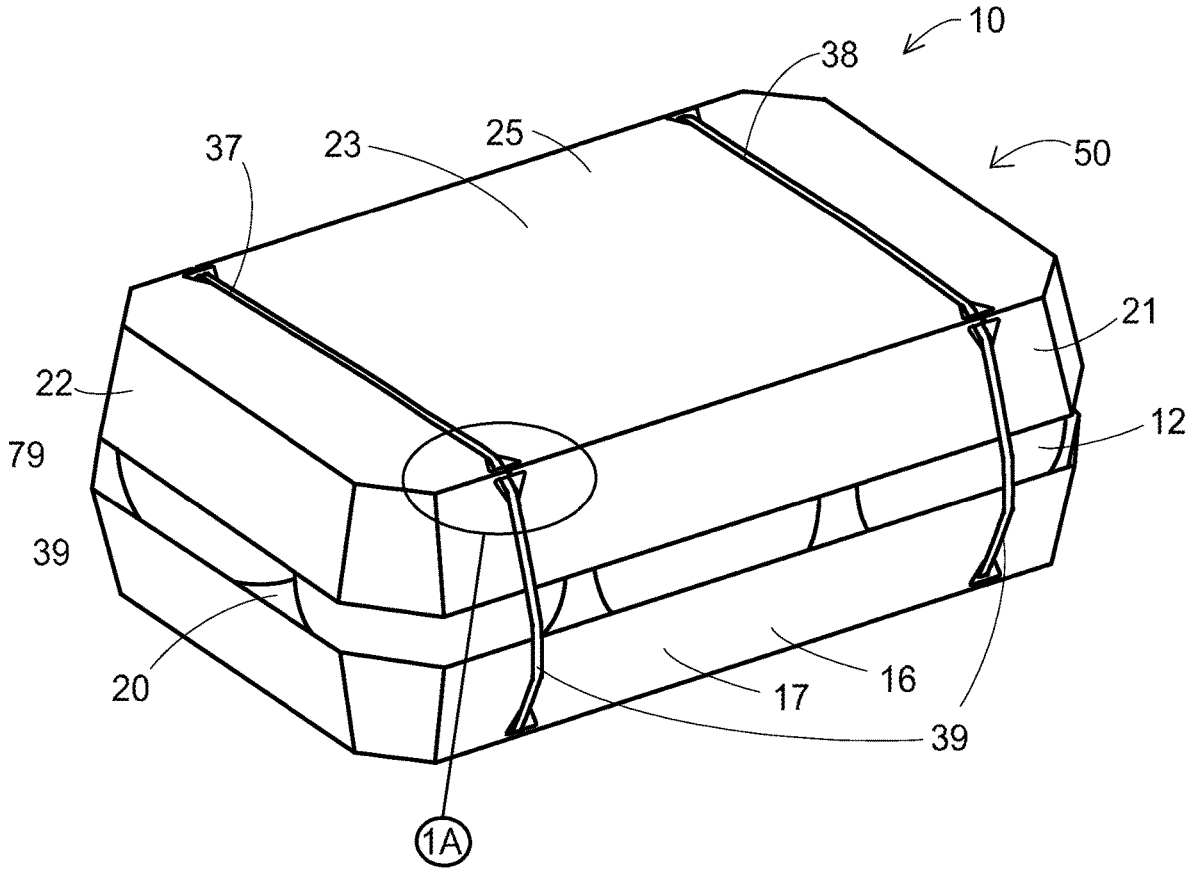
FIG. 1 is an isometric view of a banded container for articles of produce, according to an embodiment of the invention.

Reference characters included in the above drawings indicate corresponding parts throughout the several views, as discussed herein. The description herein illustrates one preferred embodiment of the invention, in one form, and the description herein is not to be construed as limiting the scope of the invention in any manner. It should be understood that the above listed figures are not necessarily to scale and may include fragmentary views, graphic symbols, diagrammatic or schematic representations. Details that are not necessary for an understanding of the present invention by one skilled in the technology of the invention, or render other details difficult to perceive, may have been omitted.

DETAILED DESCRIPTION OF SPECIFIC EMBODIMENTS

Exemplary embodiments of a banded container for articles of produce 10 will be best understood by reference to the drawings included herewith, wherein like parts are designated by like numerals throughout. It will be readily understood that the components of the device, as generally described and illustrated in the figures herein, could be arranged and designed in a wide variety of different configurations. Thus, the following more detailed description of the embodiments of the apparatus, system, and device is not intended to limit the scope of the invention, as claimed, but is merely representative of exemplary embodiments of the technology.

Figure 1A:
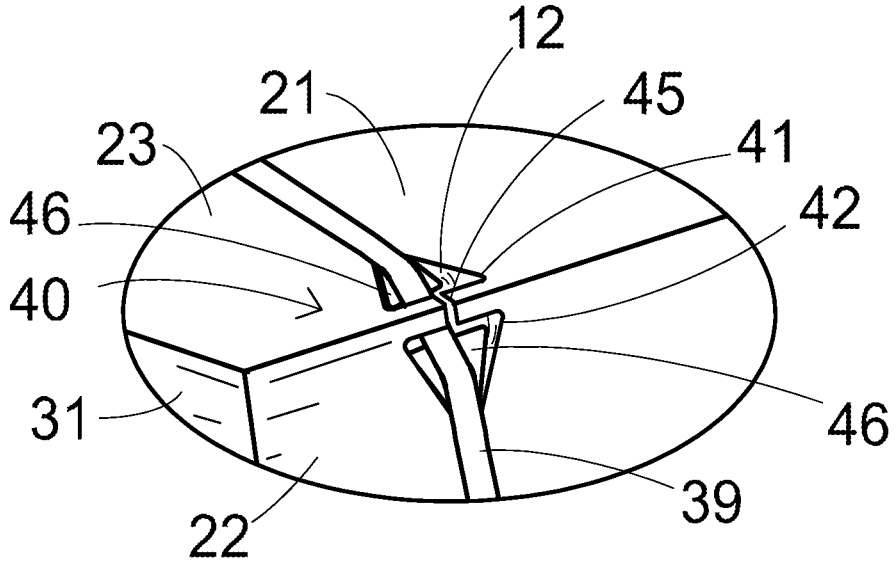
FIG. 1A is a detail of a portion of an isometric view of a banded container for articles of produce referred to in FIG. 1, according to an embodiment of the invention.
Figure 1B:
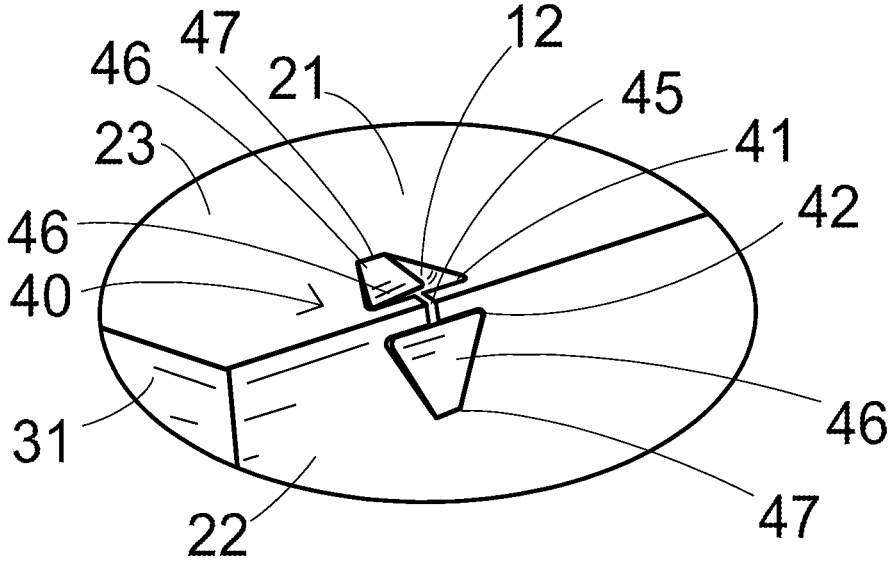
FIG. 1B is a detail of a portion of an isometric view of a banded container for articles of produce, according to an embodiment of the invention.

Referring to FIGS. 1 through 9, including FIGS. 1A and 1B, the banded container for articles of produce 10 of the present invention may more simply may be referred to herein as the "banded container", and is configured to contain or hold within, and display a multiple of produce articles 12. The multiple of produce articles may simply be referred to as the "produce articles" or more simply as the "produce". Specifically, the produce can by any produce item, typically agriculturally products such as fruits or vegetables, and most preferably fresh apples. Also alternatively, the banded container may be referred to as the "banded container for fruits and produce".

The banded container 10 provides a secure and attractive, and well ventilated shipping and display enclosure for the produce 12 contained within. The banded container allows the purchaser to inspect the contents visually, while preventing the produce articles enclosed within the banded container from being removed or dropping out.

Figure 2:
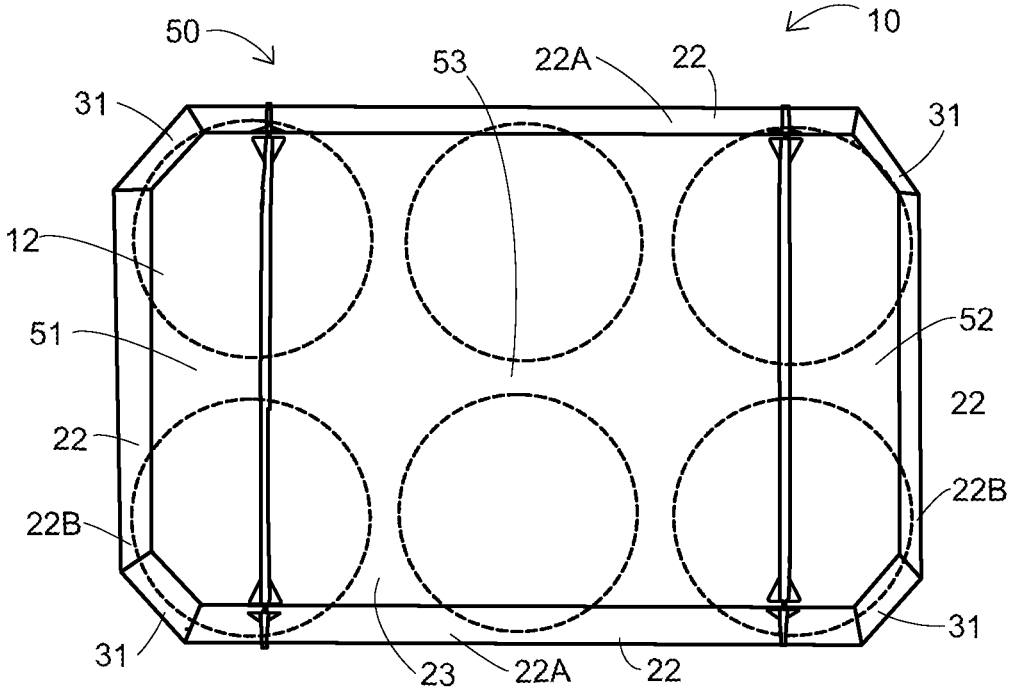
FIG. 2 is a top view of a banded container for articles of produce, according to an embodiment of the invention.
Figure 3:
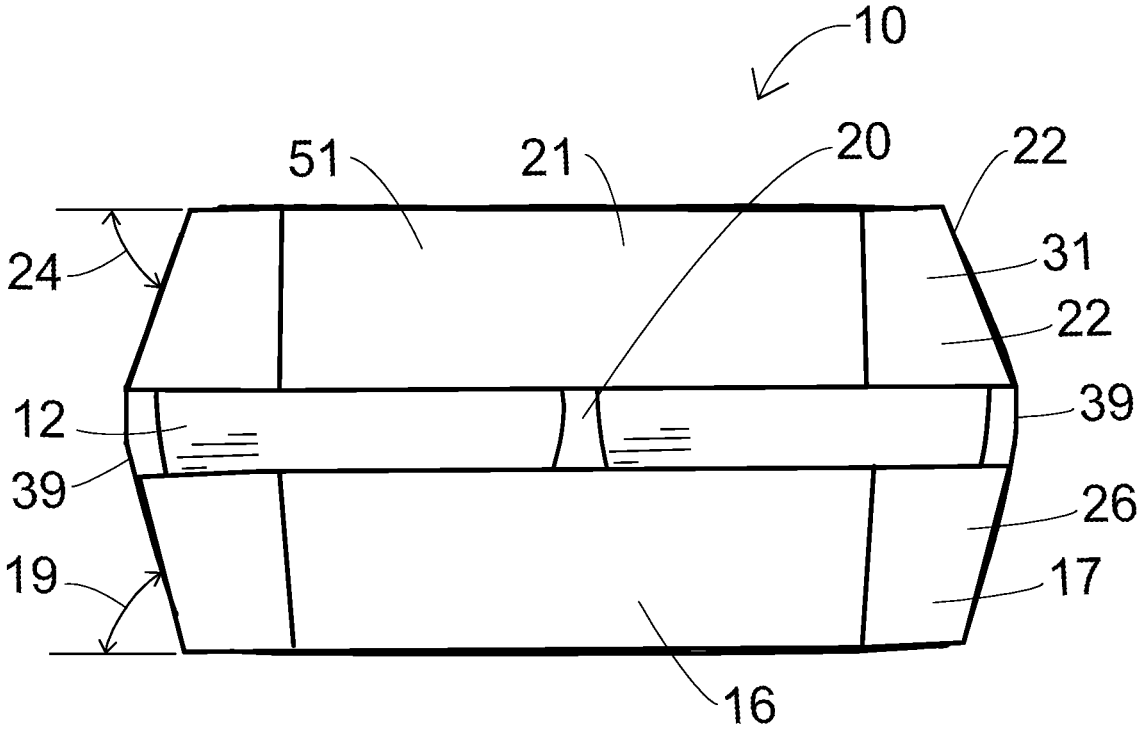
FIG. 3 is a an end view of a banded container for articles of produce, according to an embodiment of the invention

As shown in FIGS. 1 3, 4, 5, and 9, the banded container 10 includes a bottom tray 16, into which the multiple of produce articles 12 can be placed. Most preferably, the bottom tray can hold the multiple of fruit articles or items in a 3×2 arrangement as shown in FIGS. 1, 2 and 3, but alternatively any regular arraignment of 2×'s, 3×3 s, or 4×3 s, as typical for small trays configures to hold the produce items.

Figure 4:
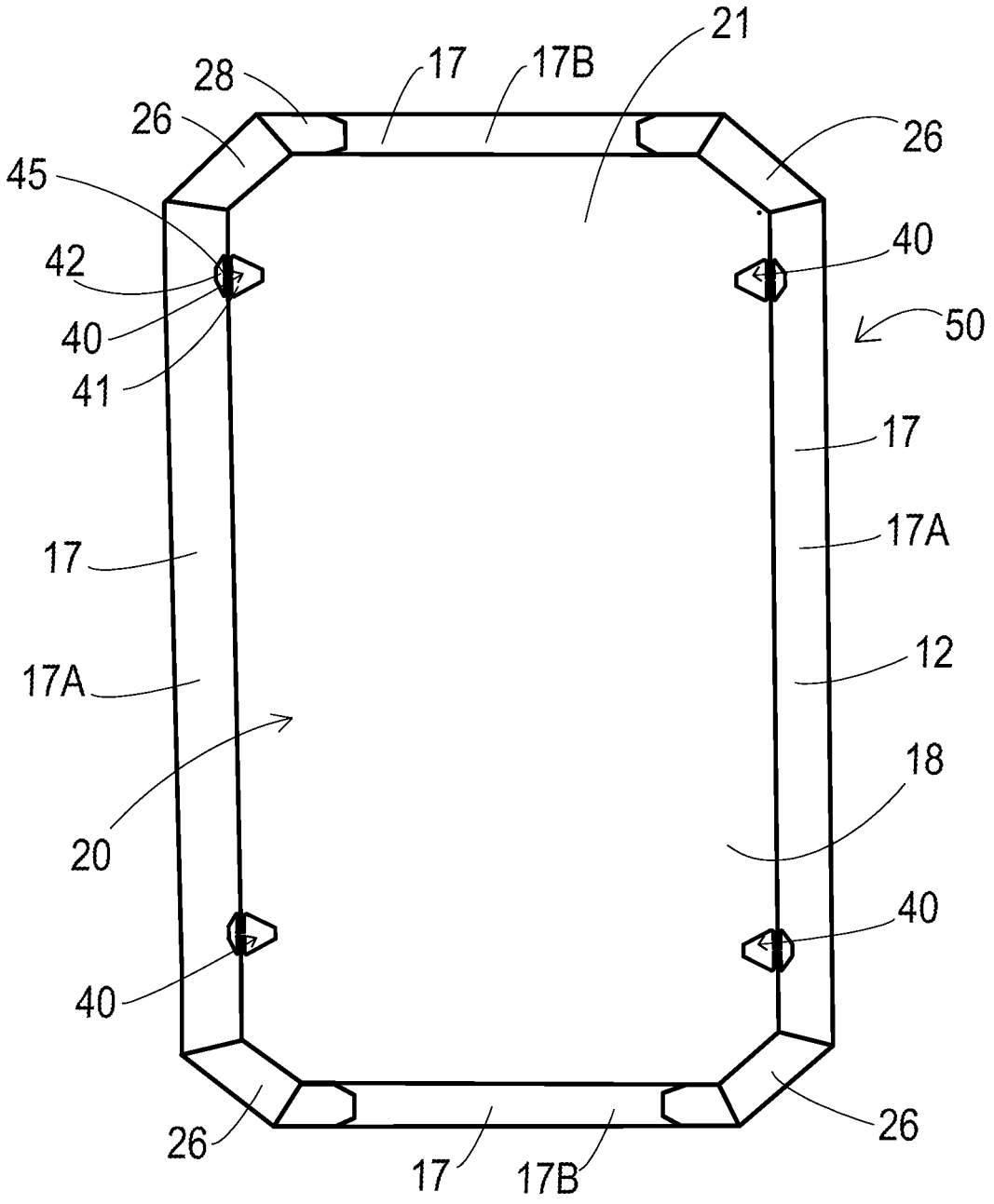
FIG. 4 is a top view of a bottom tray of the banded container for articles of produce, according to an embodiment of the invention.
Figure 5:
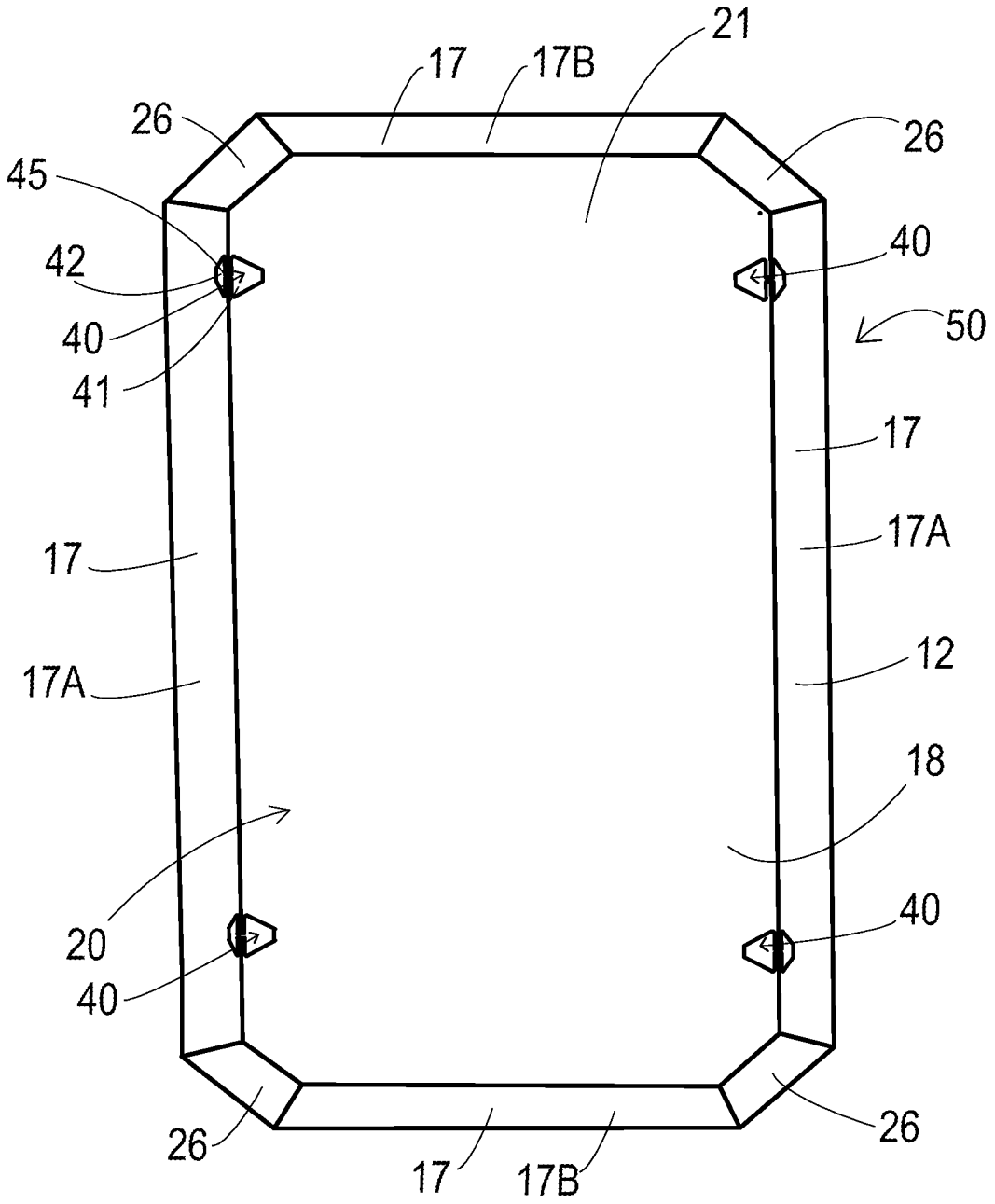
FIG. 5 is a bottom view of a bottom tray of a banded container for articles of produce, according to an embodiment of the invention.

The bottom tray 16 has bottom sides 17 as shown in FIGS. 4 and 5 that extend up from a tray bottom 18, and each of the bottom sides extend upwardly from the tray bottom to approximately one-third of the height of the produce articles 12 held within the banded container 10. This angled bottom side has a bottom side slope 19, and a preferred bottom side slope is approximately sixty degrees relative to the tray bottom, as shown in FIG. 3. Alternatively, the bottom side slope may be anywhere in the range of vertical at ninety degrees relative to the tray bottom, to as little as ten degrees.

After filling the bottom tray 16 with the produce articles, a top tray 21 that is preferably identical in construction to the bottom tray 16, is placed over the produce articles contained in the bottom tray. The produce articles are place into and within a tray space 20. Most preferably, the produce articles are generally spherical, as found in apples and packed together in an array sized to fill the tray space.

Figure 6:
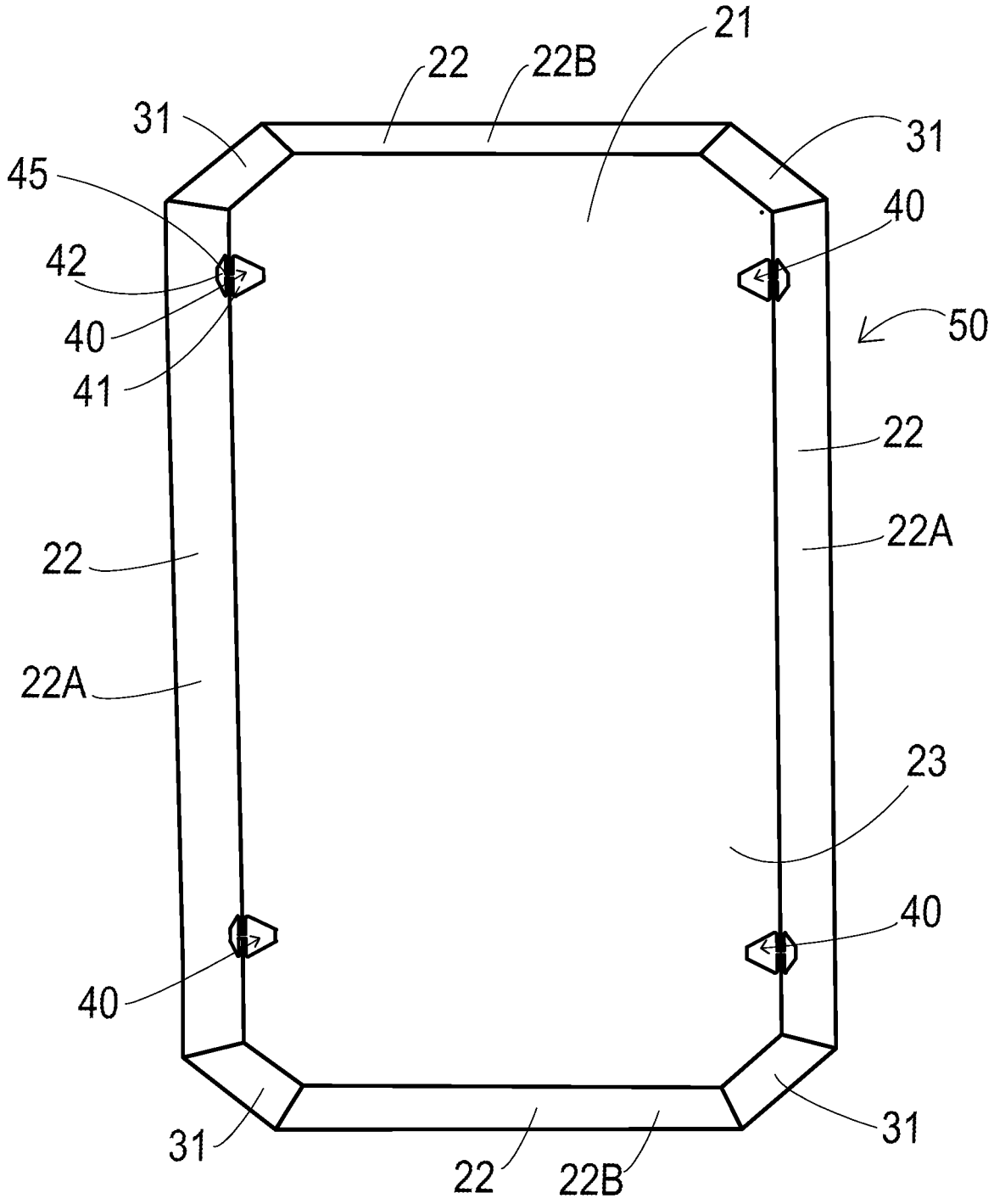
FIG. 6 is a top view of a top tray of a banded container for articles of produce, according to an embodiment of the invention.
Figure 7:
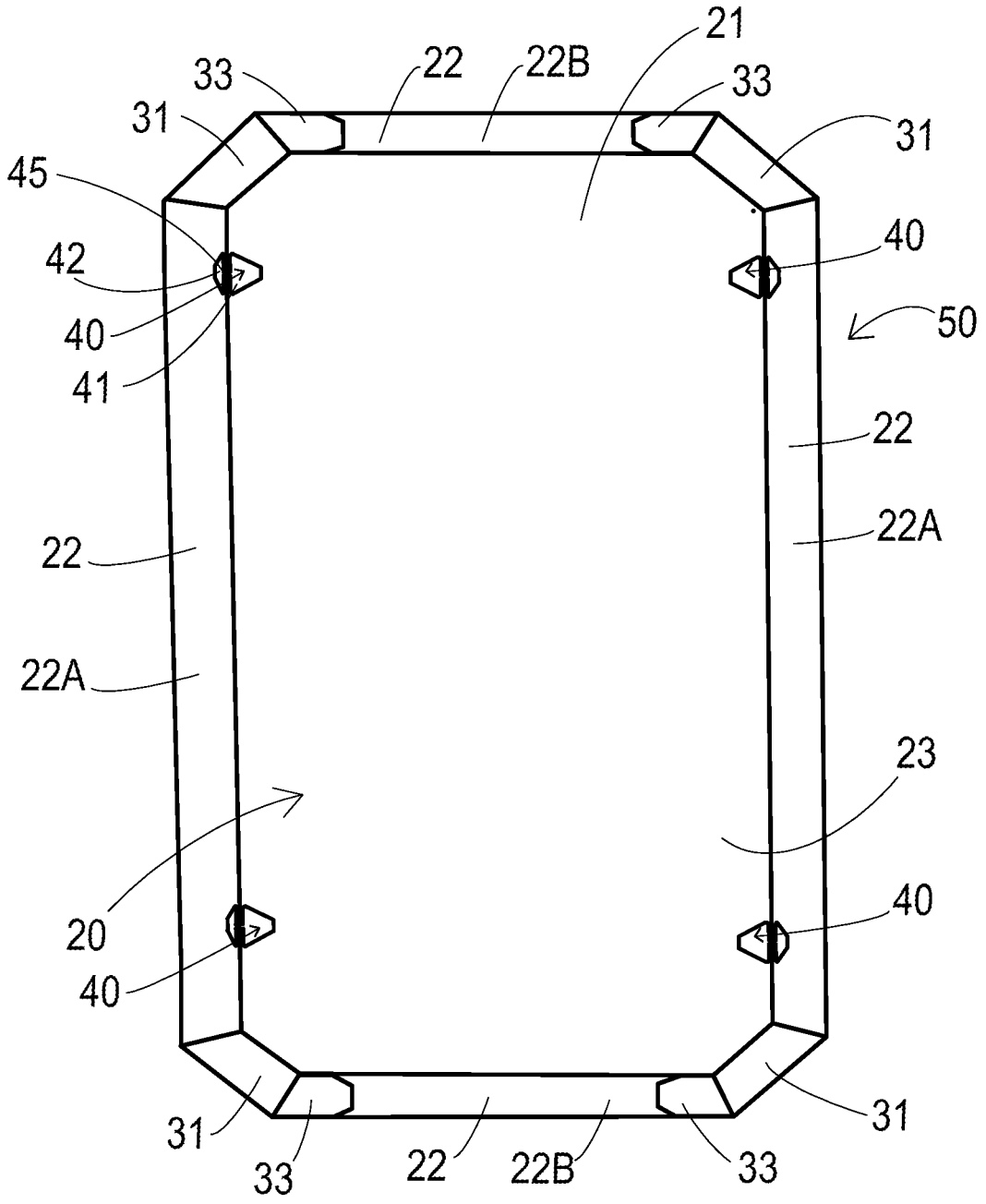
FIG. 7 is a bottom view of a top tray of a banded container for articles of produce, according to an embodiment of the invention.

Exactly as in the bottom tray 16, the top tray 21 has top sides 22 as shown in FIGS. 6 and 7 that extend down from a tray top 23, and each of the top sides extend downwardly from the tray top to approximately one-third of the height of the produce articles 12 held within the tray. This preferred top side slope 24 is approximately sixty degrees relative to the tray top, as shown in FIG. 3. Alternatively, the top side slope may be anywhere in the range of vertical at ninety degrees relative to the tray top, to as little as ten degrees.

Most preferably, the top tray 21 and the bottom tray 16 are formed or constructed from a bio-degradable and recyclable material, such as a 'kraft' paper or a cardboard 25. Similar materials could be used in the alternative, as conventionally formed of a newly produced paper pulp material, or formed of a recycled paper pulp materials in the alternative, any of which are well known to persons skilled in the selection and manufacture of pulp materials.

Figure 9:
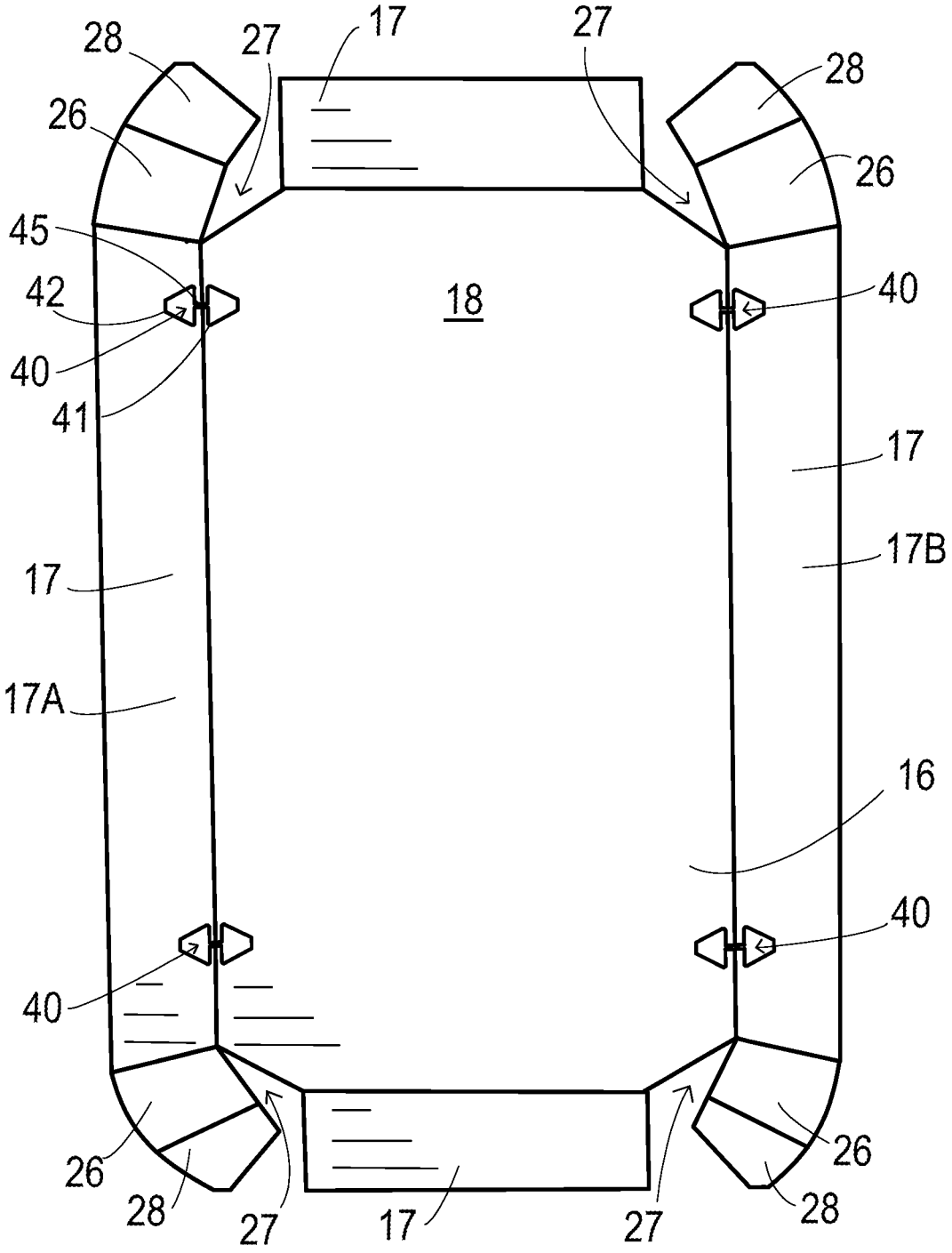
FIG. 9 is a bottom view of an unfolded bottom tray of a banded container for articles of produce, according to an embodiment of the invention.

The bottom sides 17 of the bottom tray 16 preferably extend from the tray bottom 18 and fold upward to form a set of bottom corners 26, with a bottom slit 27 at each bottom corner as shown in FIG. 9, which shows the bottom tray as un-folded or flat. To permanently form the set of bottom corners, a bottom corner tab 28 at each bottom corner extending from a first bottom side 17A can be glued to an adjacent, second bottom side 17B.

Figure 8:
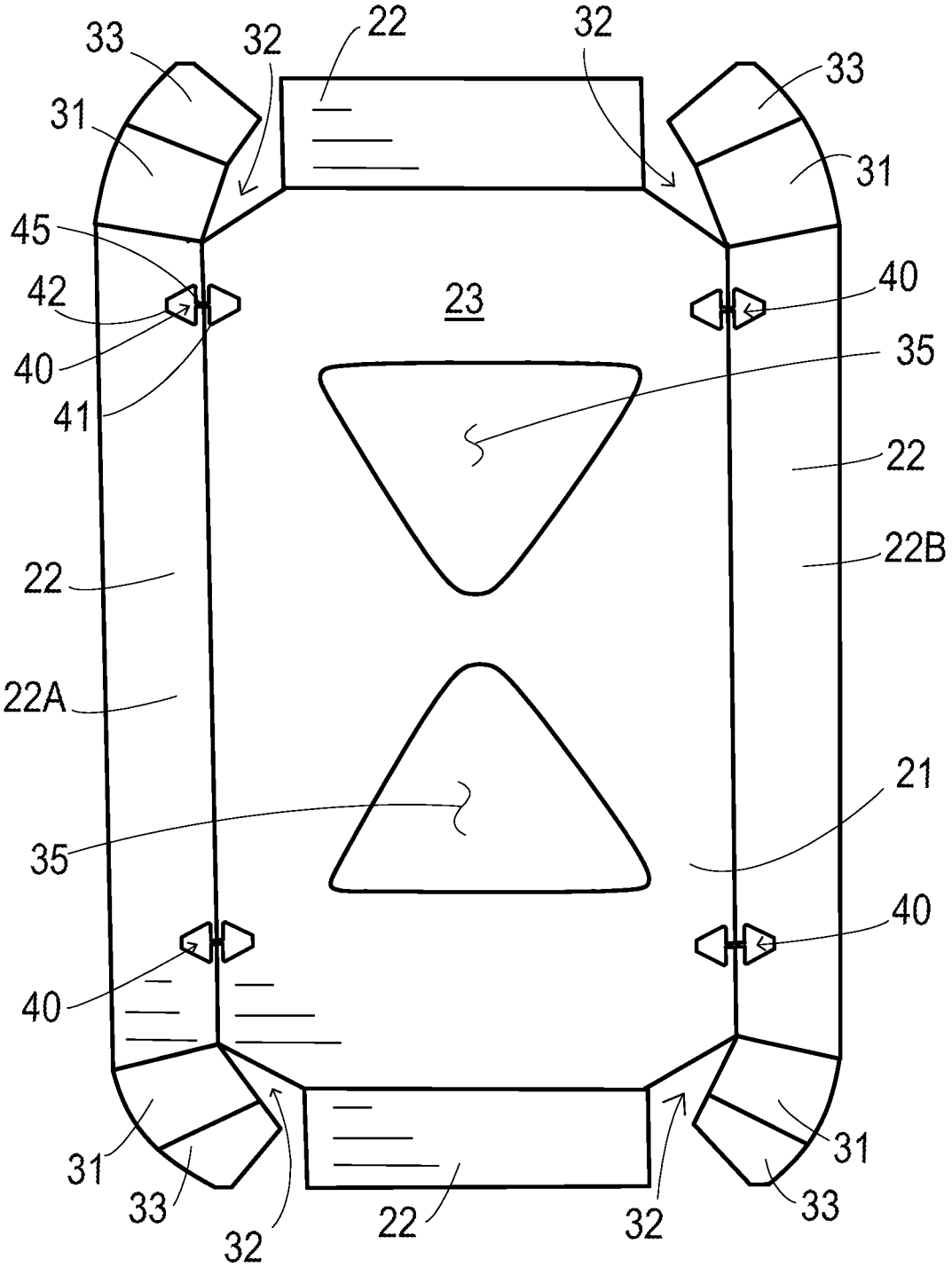
FIG. 8 is a top view of an unfolded top tray of a banded container for articles of produce in an un-folded position, according to an embodiment of the invention.

Similarly, the top sides 22 of the top tray 21 preferably extend from the tray top 23 and fold downward to form a set of top corners 31, with a top slit 32 at each top corner, as shown in FIGS. 7 and 8. To permanently form the set of top corners, a top corner tab 33 at each top corner from a first top side 22A can be glued to an adjacent, second top side 22B. Additionally, as shown in FIG. 8, which shows the top tray as un-folded or flat, the top tray can include tray openings 35, which provides for ventilation of the banded container 10, windows to view the produce 12 contained within, and a point of lifting or grabbing the container.

As shown in FIG. 1, a first elastic band 37 and a second elastic band 38 are employed in the banded container 10 to secure the top tray 21 to the bottom tray 16 and hold the produce articles 12 within the tray space 20. The first elastic band and the second elastic band are each placed around both of the top tray and the bottom tray, and each thread through the bottom sides 17 and tray bottom 18 of the try bottom, and the top sides 22 and the tray top 23 of the top tray.

The top corners 31 of the top tray 21 each include a corner-hole pair 40, as shown in FIGS. 6, 7, and 8, and detailed in FIGS. 1A and 1B. The bottom corners 26 of the bottom tray 16 each also include a corner-hole pair 40, as shown in FIGS. 4, 5, and 9. The corner-hole pairs each include a first band-hole 41 and a second band-hole 42. The first band-hole is located on the flat top surface that is the tray bottom 18 of the bottom tray, and on the flat bottom surface that is the tray top 23 of the top tray 21. The second band-hole is located on the side slope surface that is the bottom side 17 of the bottom tray, and is the top side 22 of the top tray. The first band-hole and the second band-hole of each corner-hole pair are in close proximity to each other and inter-connected by a connector-slot 45.

Preferably, the first elastic band 37 and the second elastic band 38, which may be simply referred to herein as "bands" 39, may be made of any conventional elastic ribbon or string materials, including fiber, cloth, and rubber. An elastic material is desirable, to provide a snug fit and firm hold around the top tray 21 and bottom tray 16, with the produce 12 held within tray space 20. Most preferably a sanitary, yet biodegradable material is employed for the bands.

The first elastic band 37 and the second elastic band 38 each wrap around the top tray and the bottom tray, and received into each corner-hole pair 40, with each of the bands 39 threading through the bottom sides 17 and tray bottom 18 of the try bottom, and the top sides 22 and the tray top 23 of the top tray. The bands seat into the connector slot between each first band-hole 41 and second band-hole 42. The connector slot serves as a double flapped stop to prevent the bands from walking or otherwise exiting from an end wrapped position 50, as shown in FIG. 1 and detailed in FIG. 1A.

The bands 39 each route over the exterior of the tray top 23 of the top tray 21 into the first band-hole 41, across the connector-slot 45 and out of the second band-hole 42 in the first top side 22A of the top tray. The band then continues on the exterior of the first top side of the top tray and across the tray space 20 to the first bottom side 17A of the bottom tray 16.

The bands 39 then rout into the second band-hole 42 in the first bottom side 17A of the bottom tray 16, across the connector-slot 45 and out of the first band-hole 41 of the tray bottom 18 of the bottom tray.

The bands 39 the each route over the exterior of the tray bottom 18 of the bottom tray 16 into the first band-hole 41, across the connector-slot 45 and out of the second band-hole 42 in the first bottom side 17A of the bottom tray. The band then continues on the exterior of the first bottom side of the bottom tray and across the tray space 20 to the first top side 22A of the top tray 16.

The bands 39 then complete the circuit of the top tray 21 and the bottom tray 16 by routing into the second band-hole 42 in the first top side 22A of the top tray, across the connector-slot 45 and out of the first band-hole 41 of the tray top 23 of the top tray, again to the exterior of the tray top.

With the bands 39 then placed around both the top tray 21 and the bottom tray 16, routed through each corner-hole pair 40 and held within each connector slot 45, a firm encasement of the produce 12 within the tray space 20 is achieved. Again, preferably two elastic bands are used, the first elastic band 37 at a first end 51 of the banded container 10, and the second elastic band 38 at a second end 52 of the banded container one at each end of the container. However, a single band could be employed proximate to a center region 53 of the banded container 10, or any number of bands used, regularly spaced along the top tray and bottom tray.

Additionally, the bands 39 may be removed from only the top tray 21 or only the bottom tray 16, to allow one or the other trays to be removed from the banded container 10. For instance, if the bands are removed from the corner-hole pairs 40 in the top corners 31 of the top tray, the top tray can be removed, with the bands still retained within the corner-hole pairs in the bottom corners 26 of the bottom tray.

FIG. 1A, as referred to in FIG. 1 details the corner-hole pair 40 in the top corner 31 of the top tray 21, with the bands 39 received within and threaded there through. Again, the bands are received into the first band-hole 41 and the connector slot 45, which connects to the second band-hole 42.

Similarly, for the bottom tray 16, the corner-hole pair 40 is located in each top corner 26 of the bottom tray, with the bands 39 received within and threaded there through. Again, the bands are received into the first band-hole 41 and the connector slot 45, which connects to the second band-hole 42.

FIG. 1B is the same view of the top corner 31 of the top tray 21 of FIG. 1A, with the band 39 removed, to expose a band-hole tab 46, which refers to the cut-out portion of the first band-hole 41 and the cut-out portion of the second band-hole 42. Most preferably, the band-hole tab remains connected to top tray, with a tab hinge 47. The band-hole tab hinges in the tab hinge inwardly into the tray space 20 when depressed by the bands, as received into the corner-hole pair 30.

Similarly, for the bottom tray 16, the band-hole tab 46 also remains connected to bottom tray, with the tab hinge 47. Again the band-hole tab hinges in the tab hinge inwardly into the tray space 20 when depressed by the bands, as received into the corner-hole pair 30.

The band-hole tab 46 serves well to protect the produce articles 12 within the banded container 10, from potential damage by the bands 39. In the alternative, the shape of the band-hole tab may be any convenient or desired shape, as is the shape of the first band-hole and the second band-hole. As shown in FIG. 1B, most preferred band-hole tabs are a rounded triangular in shape, but could be oval, round, or square, for example.

For this Detailed Description, the terms "connected", "attached", "coupled" and "mounted" refer to any form of interaction between two or more elements, including mechanical, electrical, magnetic, electromagnetic, fluid, and thermal interaction. Two components may be functionally coupled with or to each other, even though they are not in direct contact with each other.

Also, the terms "approximately" or "approximate" are employed herein throughout, including this detailed description and the attached claims, with the understanding that is denotes a level of exactitude commensurate with the skill and precision typical for the particular field of endeavor, as applicable.

Additionally, the terminology used in this application is to be interpreted according to ordinary and customary usage in the field of the invention as exemplified in the pertinent U.S. and International Patent Classification Codes, and equivalent codes in other patent classification systems.

The word "embodiment" is used herein to mean "serving as an example, instance, or illustration." Any embodiment described herein is not necessarily to be construed as preferred or advantageous over other embodiments. While the various aspects of the embodiments are presented in drawings, the drawings are not necessarily drawn to scale.

Additionally, reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment.

Similarly, it should be appreciated that in the above Detailed Description, various features are sometimes grouped together in a single embodiment, figure, or description thereof for the purpose of streamlining this disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description together with the accompanying drawings referred to herein as the disclosure, with each claim standing on its own as a separate embodiment. This disclosure includes all permutations of the independent claims with their dependent claims.

In compliance with the statutes, the invention has been described in language more or less specific as to structural features and process steps where applicable. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described.

Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

What is claimed is:

1. A banded container for articles of produce, the banded container comprising:

a bottom tray into which a multiple of produce articles can be received, the multiple of produce articles having a produce height, the bottom tray having a tray bottom and a set of four bottom sides connected to the tray bottom, the set of four bottom sides including a first bottom side, a second bottom side, a third bottom side, and a fourth bottom side, the set of four bottom sides each extending upwardly from the tray bottom to approximately one-third of a produce height of the multiple of produce articles, and the multiple of produce articles receivable and holdable within the bottom tray;

a top tray located above the bottom tray, the top tray including a tray top and a set of four top sides connected to the tray top, the set of four top sides includes a first top side, a second top side, a third top side, and a fourth top side, and the set of four top sides each extend downwardly from the tray top to approximately one-third of the produce height of the multiple of produce articles receivable and holdable within the banded container;

the multiple of produce articles held in an interior tray space within the banded container;

with each the set of four bottom sides of the bottom tray folded upward from the tray bottom to meet together to form a set of four bottom corners, the set of four bottom corners including a first bottom corner, a second bottom corner, a third bottom corner, and a fourth bottom corner;

with each of the set of four top sides of the top tray folded downward from the tray top to meet together to form a set of four top corners, the set of four top corners including a first top corner, a second top corner, a third top corner, and a fourth top corner;

a first bottom band-hole located on the tray bottom of the bottom tray proximate to the first bottom side of the bottom tray and proximate to the first bottom corner, and a first bottom side band-hole located on the first bottom side of the bottom tray in close proximity to the first bottom band-hole and proximate to the first bottom corner, the first bottom band-hole and the first bottom side band-hole comprising a first bottom corner-hole pair, and the first bottom band-hole and the first bottom side band-hole are inter-connected by a first bottom connector-slot;

a second bottom band-hole located on the tray bottom of the bottom tray proximate to the first bottom side of the bottom tray and proximate to the second bottom corner, and a second bottom side band-hole located on the first bottom side of the bottom tray in close proximity to the second bottom band-hole and proximate to the second bottom corner, the second bottom band-hole and the second bottom side band-hole comprising a second bottom corner-hole pair, and the second bottom band-hole and the second bottom side band-hole are inter-connected by a second bottom connector-slot;

a third bottom band-hole located on the tray bottom of the bottom tray proximate to the third top side of the bottom tray and proximate to the third bottom corner, and a third bottom side band-hole located on the third bottom side of bottom top tray in close proximity to the third bottom band-hole and proximate to the third bottom corner, the third bottom band-hole and the third bottom side band-hole comprising a third bottom corner-hole pair, and the third bottom band-hole and the third bottom side band-hole are inter-connected by a third bottom connector-slot;

a fourth bottom band-hole located on the tray bottom of the bottom tray proximate to the third bottom side of the bottom tray and proximate to the fourth bottom corner, and a fourth bottom side band-hole located on the third bottom side of the bottom tray in close proximity to the fourth bottom band-hole and proximate to the fourth bottom corner, the fourth bottom band-hole and the fourth bottom side band-hole comprising a fourth bottom corner-hole pair, and the fourth bottom band-hole and the fourth bottom side band-hole are inter-connected by a fourth bottom connector-slot;

a first top band-hole located on the tray top of the top tray proximate to the first top side of the top tray and proximate to the first top corner, and a first top side band-hole located on the first top side of the top tray in close proximity to the first top band-hole and proximate to the first top corner, the first top band-hole and the first top side band-hole comprising a first top corner-hole pair, and the first top band-hole and the first top side band-hole are inter-connected by a first top connector-slot;

a second top band-hole located on the tray top of the top tray proximate to the first top side of the top tray and proximate to the second top corner, and a second top side band-hole located on the first top side of the top tray in close proximity to the second top band-hole and proximate to the second top corner, the second top band-hole and the second top side band-hole comprising a second top corner-hole pair, and the second top band-hole and the second side band-hole are inter-connected by a second top connector-slot;

a third top band-hole located on the tray top of the top tray proximate to the third top side of the top tray and proximate to the third top corner, and a third top side band-hole located on the third top side of the top tray in close proximity to the third top band-hole and proximate to the third top corner, the third top band-hole and the third top side band-hole comprising a third top corner-hole pair, and the third top band-hole and the third top side band-hole are inter-connected by a third top connector-slot;

a fourth top band-hole located on the tray top of the top tray proximate to the third top side of the top tray and proximate to the fourth top corner, and a fourth top side band-hole located on the third top side of the top tray in close proximity to the fourth top band-hole and proximate to the fourth top corner, the fourth top band-hole and the fourth top side band-hole comprising a fourth top corner-hole pair, and the fourth top band-hole and the fourth top side band-hole are inter-connected by a fourth top connector-slot;

the top tray secured to the bottom tray with a first band, the first band placed around the top tray and the bottom tray, with the first band seated within the first top connector-slot from the first top band-hole to the first top side band-hole and within the third top connector-slot from the fourth top band-hole to the fourth top side band-hole of the tray top, and the first band seated within the first bottom connector-slot from the first bottom band-hole to the first bottom side band-hole and within the fourth bottom connector-slot from the fourth bottom band-hole to the fourth bottom side band-hole of the tray bottom, the top tray secured to the bottom tray with a second band, the second band placed around the top tray and the bottom tray, with the second band seated into within the second top connector-slot from the second top band-hole to the second top side band-hole and within the third top connector-slot from the third top band-hole to the third top side band-hole of the tray top, and the second band seated within the second bottom connector-slot from the second bottom band-hole to the second bottom side band-hole and within the third bottom connector-slot from the third top band-hole to the third bottom side band-hole of the tray bottom;

a first band-hole bottom tab comprising a first bottom cut-out portion of the first bottom band-hole with the first band-hole bottom tab remaining connected to the tray bottom of the bottom tray with a first bottom tab hinge, and a first band-hole bottom side tab comprising a first bottom side cut-out portion of the first bottom side band-hole, with the first band-hole bottom side tab remaining connected to first bottom side of the bottom tray with a first bottom side tab hinge, and with the first band-hole bottom tab and the first band-hole bottom side tab hinge inwardly hinged into an interior tray space within the banded container, when the first band-hole bottom tab and the first band-hole bottom side tab are depressed by the first band as received into the first bottom corner-hole pair and the first bottom connector-slot;

a second band-hole bottom tab comprising a second bottom cut-out portion of the second bottom band-hole with the second band-hole bottom tab remaining connected to the tray bottom of the bottom tray with a second bottom tab hinge, and a second band-hole bottom side tab comprising a second bottom side cut-out portion of the second bottom side band-hole, with the second band-hole bottom side tab remaining connected to first bottom side of the top tray with a second bottom side tab hinge, and with the second band-hole bottom tab and the second band-hole bottom side tab hinge inwardly hinged into the interior tray space within the banded container, when the second band-hole bottom tab and the second band-hole bottom side tab are depressed by the second band as received into the second bottom corner-hole pair and the second bottom connector-slot;

a third band-hole bottom tab comprising a third bottom cut-out portion of the third bottom band-hole with the third band-hole bottom tab remaining connected to the tray bottom of the bottom tray with a third bottom tab hinge, and a third band-hole bottom side tab comprising a third bottom side cut-out portion of the third bottom side band-hole, with the third band-hole bottom side tab remaining connected to third bottom side of the bottom tray with a third bottom side tab hinge, and with the third band-hole bottom tab and the third band-hole bottom side tab hinge inwardly hinged into the interior tray space within the banded container, when the third band-hole bottom tab and the third band-hole bottom side tab are depressed by the second band as received into the third bottom corner-hole pair and the third bottom connector-slot;

a fourth band-hole bottom tab comprising a fourth bottom cut-out portion of the fourth bottom band-hole with the fourth band-hole bottom tab remaining connected to the tray bottom of the bottom tray with a fourth bottom tab hinge, and a fourth band-hole bottom side tab comprising a fourth bottom side cut-out portion of the fourth bottom side band-hole, with the fourth band-hole bottom side tab remaining connected to third bottom side of the top tray with a fourth bottom side tab hinge, and with the fourth band-hole bottom tab and the fourth band-hole bottom side tab hinge inwardly hinged into the interior tray space within the banded container, when the fourth band-hole bottom tab and the fourth band-hole bottom side tab are depressed by the first band as received into the fourth bottom corner-hole pair and the fourth bottom connector-slot;

a first band-hole top tab comprising a first top cut-out portion of the first top band-hole with the first band-hole top tab remaining connected to the tray top of the top tray with a first top tab hinge, and a first band-hole top side tab comprising a first top side cut-out portion of the first top side band-hole, with the first band-hole top side tab remaining connected to first top side of the top tray with a first top side tab hinge, and with the first band-hole top tab and the first band-hole top side tab hinge inwardly hinged into the interior tray space within the banded container, when the first band-hole top tab and the first band-hole top side tab are depressed by the first band as received into the first top corner-hole pair and the first top connector-slot;

a second band-hole top tab comprising a second top cut-out portion of the second top band-hole with the second band-hole top tab remaining connected to the tray top of the top tray with a second top tab hinge, and a second band-hole top side tab comprising a second top side cut-out portion of the second top side band-hole, with the second band-hole top side tab remaining connected to first top side of the top tray with a second top side tab hinge, and with the second band-hole top tab and the second band-hole top side tab hinge inwardly hinged into the interior tray space within the banded container, when the second band-hole top tab and the second band-hole top side tab are depressed by the second band as received into the second top corner-hole pair and the second top connector-slot;

a third band-hole top tab comprising a third top cut-out portion of the third top band-hole with the third band-hole top tab remaining connected to the tray top of the top tray with a third top tab hinge, and a third band-hole top side tab comprising a third top side cut-out portion of the third top side band-hole, with the third band-hole top side tab remaining connected to third top side of the top tray with a third top side tab hinge, and with the third band-hole top tab and the third band-hole top side tab hinge inwardly hinged into the interior tray space within the banded container, when the third band-hole top tab and the third band-hole top side tab are depressed by the second band as received into the third top corner-hole pair and the third top connector-slot;

a fourth band-hole top tab comprising a fourth top cut-out portion of the fourth top band-hole with the fourth band-hole top tab remaining connected to the tray top of the top tray with a fourth top tab hinge, and a fourth band-hole top side tab comprising a fourth top side cut-out portion of the fourth top side band-hole, with the fourth band-hole top side tab remaining connected to third top side of the top tray with a fourth top side tab hinge, and with the fourth band-hole top tab and the fourth band-hole top side tab hinge inwardly hinged into the interior tray space within the banded container, when the fourth band-hole top tab and the fourth band-hole top side tab are depressed by the first band as received into the fourth top corner-hole pair and the fourth top connector-slot; and the first band-hole bottom tab, the first band-hole bottom side tab, the first band-hole top side tab, the first band-hole top tab, the fourth band-hole bottom tab, the fourth band-hole bottom side tab, the fourth band-hole top side tab and the fourth band-hole top tab are depressed by the first band and positioned within the first band is a first produce article of said multiple of produce articles, and the second band-hole bottom tab, the second band-hole bottom side tab, the second band-hole top side tab, the second band-hole top tab, the third band-hole bottom tab, the third band-hole bottom side tab, the third band-hole top side tab and the third band-hole top tab are depressed by the second band and positioned within the second band is a second produce article of said multiple of produce articles.

2. The banded container of claim 1, wherein:

the first band is a continuous band made of an elastic material, and the second band is a continuous band made of an elastic material.

3. The banded container of claim 1, wherein:

the set of four bottom sides each have a bottom side slope relative to the tray bottom, of approximately sixty degrees relative to the tray bottom.

4. The banded container of claim 1, wherein:

the set of four top sides each have a top side slope relative to the tray top, of approximately sixty degrees relative to the tray top.

5. The banded container of claim 1, wherein:

the set of four top sides each have a top side slope relative to the tray top, of between ninety degrees and ten degrees relative to the tray top.

6. The banded container of claim 1, wherein:

the first band wraps around an exterior surface of the top tray and an exterior surface of the bottom tray, and the second band wraps around an exterior surface of the top tray and an exterior surface of the bottom tray;

with the first band received into the first top corner-hole pair and the first top connector slot, the second top corner-hole pair and the second top connector slot, the first bottom corner-hole pair and the first bottom connector slot, the second bottom corner-hole pair and the second bottom connector slot, with the first top connector slot, the second top connector slot, the first bottom connector slot, and the second bottom connector slot each serving as a first band stop, to prevent the first band from exiting from a first end wrapped position around the top tray and the bottom tray of the banded container; and the second band received into the third top corner-hole pair and the third top connector slot, the fourth top corner-hole pair and the fourth top connector slot, the third bottom corner-hole pair and the third bottom connector slot, the fourth bottom corner-hole pair and the fourth bottom connector slot, with the third top connector slot, the fourth top connector slot the third bottom connector slot and the fourth bottom connector slot each serving as a second band stop, to prevent the second band from exiting from a second end wrapped position around the top tray and the bottom tray of the banded container.

7. A banded container for articles of produce, the banded container comprising:

a bottom tray into which a multiple of produce articles can be received, the multiple of produce articles having a produce height, the bottom tray having a tray bottom and a set of four bottom sides connected to the tray bottom, the set of four bottom sides including a first bottom side, a second bottom side, a third bottom side, and a fourth bottom side, the set of four bottom sides each extending upwardly from the tray bottom to approximately one-third of a produce height of the multiple of produce articles, and the multiple of produce articles receivable and holdable within the bottom tray;

a top tray located above the bottom tray, the top tray including a tray top and a set of four top sides connected to the tray top, the set of four top sides includes a first top side, a second top side, a third top side, and a fourth top side, and the set of four top sides each extend downwardly from the tray top to approximately one-third of the produce height of the multiple of produce articles receivable and holdable within the banded container;

with each the set of four bottom sides of the bottom tray folded upward from the tray bottom to meet together to form a set of four bottom corners, the set of four bottom corners including a first bottom corner, a second bottom corner, a third bottom corner and a fourth bottom corner, and a first bottom corner-hole pair located proximate to the first bottom corner, a second bottom corner-hole pair located proximate to the second bottom corner, a third bottom corner-hole pair located proximate to the third bottom corner and a fourth bottom corner-hole pair located proximate to the fourth bottom corner;

with each of the set of four top sides of the top tray folded downward from the tray top to meet together to form a set of four top corners, the set of four top corners including a first top corner, a second top corner, a third top corner and a fourth top corner, and a first top corner-hole pair located proximate to the first top corner, a second top corner-hole pair located proximate to the second top corner, a third top corner-hole pair located proximate to the third top corner, and a fourth top corner-hole pair located proximate to the fourth top corner;

the first top corner-hole pair having a first top band-hole and a first top side band-hole, the first top band-hole located on the tray top of the top tray, and the first top side band-hole located on the second top side of the top tray;

the second top corner-hole pair having a second top band-hole and a second top side band-hole, the second top band-hole located on the tray top of the top tray, and the second top side band-hole located on the second top side of the top tray;

the third top corner-hole pair having a third top band-hole and a third top side band-hole, the third top band-hole located on the tray top of the top tray, and the third top side band-hole located on the fourth top side of the top tray;

the fourth top corner-hole pair having a fourth top band-hole and a fourth top side band-hole, the fourth top band-hole located on the tray top of the top tray, and the fourth top side band-hole located on the fourth top side of the top tray;

the first bottom corner-hole pair having a first bottom band-hole and a first bottom side band-hole, the first bottom band-hole located on the tray bottom of the bottom tray, and the first bottom side band-hole located on the second bottom side of the bottom tray;

the second bottom corner-hole pair having a second bottom band-hole and a second bottom side band-hole, the second bottom band-hole located on the tray bottom of the bottom tray, and the second bottom side band-hole located on the second bottom side of the bottom tray;

the third bottom corner-hole pair having a third bottom band-hole and a third bottom side band-hole, the third bottom band-hole located on the tray bottom of the bottom tray, and the third top side band-hole located on the fourth bottom side of the bottom tray;

the fourth bottom corner-hole pair having a fourth bottom band-hole and a fourth bottom side band-hole, the fourth bottom band-hole located on the tray bottom of the bottom tray, and the fourth bottom side band-hole located on the fourth bottom side of the bottom tray;

the first top band-hole and the first top side band-hole of the first top corner-hole pair are in close proximity to each other and inter-connected by a first top connector-slot;

the second top band-hole and the second top side band-hole of the second top corner-hole pair are in close proximity to each other and inter-connected by a second top connector-slot;

the third top band-hole and the third top side band-hole of the third top corner-hole pair are in close proximity to each other and inter-connected by a third top connector-slot;

the fourth top band-hole and the fourth top side band-hole of the fourth top corner-hole pair are in close proximity to each other and inter-connected by a fourth top connector-slot;

the first bottom band-hole and the bottom side band-hole of the first bottom corner-hole pair are in close proximity to each other and inter-connected by a first bottom connector-slot;

the second bottom band-hole and the second bottom side band-hole of the second bottom corner-hole pair are in close proximity to each other and inter-connected by a second bottom connector-slot;

the third bottom band-hole and the third bottom side band-hole of the third bottom corner-hole pair are in close proximity to each other and inter-connected by a third bottom connector-slot;

the fourth bottom band-hole and the fourth bottom side band-hole of the fourth bottom corner-hole pair are in close proximity to each other and inter-connected by a fourth bottom connector-slot;

the top tray secured to the bottom tray with a first elastic band, the first elastic band placed around the top tray and the bottom tray, with the first elastic band threaded through the first top side band-hole, the first top connector-slot and the first top band-hole, the first elastic band threaded through the second top band-hole, the second top connector-slot and the second top side band-hole, and the first elastic band threaded through the second bottom side band-hole, the second bottom connector-slot and the second bottom band-hole, and the first elastic band threaded through the first bottom band-hole, the first bottom connector-slot and the first bottom side band-hole;

the top tray secured to the bottom tray with a second elastic band, the second elastic band placed around the top tray and the bottom tray, with the second elastic band threaded through the fourth top side band-hole, the fourth top connector-slot and the fourth top band-hole, the second elastic band threaded through the third top band-hole, the third top connector-slot and the third top side band-hole, and the second elastic band threaded through the third bottom side band-hole, the third bottom connector-slot and the third bottom band-hole, and the second elastic band threaded through the fourth bottom band-hole, the fourth bottom connector-slot and the fourth bottom side band-hole;

a first band-hole top tab comprising a first top cut-out portion of the first top band-hole with the first band-hole top tab remaining connected to the tray top of the top tray with a first top tab hinge, and a first band-hole top side tab comprising a first top side cut-out portion of the first top side band-hole, with the first band-hole top side tab remaining connected to first top side of the top tray with a first top side tab hinge, and with the first band-hole top tab and the first band-hole top side tab hinge inwardly hinged into an interior tray space within the banded container, when the first band-hole top tab and the first band-hole top side tab are depressed by the first band as received into the first top corner-hole pair and the first top connector-slot;

a second band-hole top tab comprising a second top cut-out portion of the second top band-hole with the second band-hole top tab remaining connected to the tray top of the top tray with a second top tab hinge, and a second band-hole top side tab comprising a second top side cut-out portion of the second top side band-hole, with the second band-hole top side tab remaining connected to first top side of the top tray with a second top side tab hinge, and with the second band-hole top tab and the second band-hole top side tab hinge inwardly hinged into the interior tray space within the banded container, when the second band-hole top tab and the second band-hole top side tab are depressed by the second band as received into the second top corner-hole pair and the second top connector-slot;

a third band-hole top tab comprising a third top cut-out portion of the third top band-hole with the third band-hole top tab remaining connected to the tray top of the top tray with a third top tab hinge, and a third band-hole top side tab comprising a third top side cut-out portion of the third top side band-hole, with the third band-hole top side tab remaining connected to third top side of the top tray with a third top side tab hinge, and with the third band-hole top tab and the third band-hole top side tab hinge inwardly hinged into the interior tray space within the banded container, when the third band-hole top tab and the third band-hole top side tab are depressed by the second band as received into the third top corner-hole pair and the third top connector-slot;

a fourth band-hole top tab comprising a fourth top cut-out portion of the fourth top band-hole with the fourth band-hole top tab remaining connected to the tray top of the top tray with a fourth top tab hinge, and a fourth band-hole top side tab comprising a fourth top side cut-out portion of the fourth top side band-hole, with the fourth band-hole top side tab remaining connected to third top side of the top tray with a fourth top side tab hinge, and with the fourth band-hole top tab and the fourth band-hole top side tab hinge inwardly hinged into the interior tray space within the banded container, when the fourth band-hole top tab and the fourth band-hole top side tab are depressed by the first band as received into the fourth top corner-hole pair and the fourth top connector-slot;

a first band-hole bottom tab comprising a first bottom cut-out portion of the first bottom band-hole with the first band-hole bottom tab remaining connected to the tray bottom of the bottom tray with a first bottom tab hinge, and a first band-hole bottom side tab comprising a first bottom side cut-out portion of the first bottom side band-hole, with the first band-hole bottom side tab remaining connected to first bottom side of the bottom tray with a first bottom side tab hinge, and with the first band-hole bottom tab and the first band-hole bottom side tab hinge inwardly hinged into an interior tray space within the banded container, when the first band-hole bottom tab and the first band-hole bottom side tab are depressed by the first band as received into the first bottom corner-hole pair and the first bottom connector-slot;

a second band-hole bottom tab comprising a second bottom cut-out portion of the second bottom band-hole with the second band-hole bottom tab remaining connected to the tray bottom of the bottom tray with a second bottom tab hinge, and a second band-hole bottom side tab comprising a second bottom side cut-out portion of the second bottom side band-hole, with the second band-hole bottom side tab remaining connected to first bottom side of the top tray with a second bottom side tab hinge, and with the second band-hole bottom tab and the second band-hole bottom side tab hinge inwardly hinged into the interior tray space within the banded container, when the second band-hole bottom tab and the second band-hole bottom side tab are depressed by the second band as received into the second bottom corner-hole pair and the second bottom connector-slot;

a third band-hole bottom tab comprising a third bottom cut-out portion of the third bottom band-hole with the third band-hole bottom tab remaining connected to the tray bottom of the bottom tray with a third bottom tab hinge, and a third band-hole bottom side tab comprising a third bottom side cut-out portion of the third bottom side band-hole, with the third band-hole bottom side tab remaining connected to third bottom side of the bottom tray with a third bottom side tab hinge, and with the third band-hole bottom tab and the third band-hole bottom side tab hinge inwardly hinged into the interior tray space within the banded container, when the third band-hole bottom tab and the third band-hole bottom side tab are depressed by the second band as received into the third bottom corner-hole pair and the third bottom connector-slot;

a fourth band-hole bottom tab comprising a fourth bottom cut-out portion of the fourth bottom band-hole with the fourth band-hole bottom tab remaining connected to the tray bottom of the bottom tray with a fourth bottom tab hinge, and a fourth band-hole bottom side tab comprising a fourth bottom side cut-out portion of the fourth bottom side band-hole, with the fourth band-hole bottom side tab remaining connected to third bottom side of the top tray with a fourth bottom side tab hinge, and with the fourth band-hole bottom tab and the fourth band-hole bottom side tab hinge inwardly hinged into the interior tray space within the banded container, when the fourth band-hole bottom tab and the fourth band-hole bottom side tab are depressed by the first band as received into the fourth bottom corner-hole pair and the fourth bottom connector-slot; and the multiple of produce articles held within the interior tray space of the banded container.

8. The banded container of claim 7, wherein the first elastic band is continuous and the second elastic band continuous.

9. The banded container of claim 7, wherein:

the first elastic band wraps around an exterior surface of the top tray and an exterior surface of the bottom tray, and the second elastic band wraps around an exterior surface of the top tray and an exterior surface of the bottom tray;

with the first elastic band received into the first top corner-hole pair and the first top connector slot, the second top corner-hole pair and the second top connector slot, the first bottom corner-hole pair and the first bottom connector slot, the second bottom corner-hole pair and the second bottom connector slot, with the first top connector slot, the second top connector slot, the first bottom connector slot, and the second bottom connector slot each serving as a first band stop, to prevent the first elastic band from exiting from a first end wrapped position around the top tray and the bottom tray of the banded container; and the second elastic band received into the third top corner-hole pair and the third top connector slot, the fourth top corner-hole pair and the fourth top connector slot, the third bottom corner-hole pair and the third bottom connector slot, the fourth bottom corner-hole pair and the fourth bottom connector slot, with the third top connector slot, the fourth top connector slot the third bottom connector slot and the fourth bottom connector slot each serving as a second band stop, to prevent the second elastic band from exiting from a second end wrapped position around the top tray and the bottom tray of the banded container.

10. The banded container of claim 7, wherein:

the set of four bottom sides each have a bottom side slope relative to the tray bottom, of approximately sixty degrees relative to the tray bottom.

11. The banded container of claim 7, wherein:

the set of four top sides each have a top side slope relative to the tray top, of approximately sixty degrees relative to the tray top.

12. The banded container of claim 7, wherein:

the set of four top sides each have a top side slope relative to the tray top, of between ninety degrees and ten degrees relative to the tray top.

13. The banded container of claim 7, wherein:

the first band-hole bottom tab, the first band-hole bottom side tab, the first band-hole top side tab, the first band-hole top tab, the fourth band-hole bottom tab, the fourth band-hole bottom side tab, the fourth band-hole top side tab and the fourth band-hole top tab are depressed by the first band and positioned within the first band is a first produce article of said multiple of produce articles, and the second band-hole bottom tab, the second band-hole bottom side tab, the second band-hole top side tab, the second band-hole top tab, the third band-hole bottom tab, the third band-hole bottom side tab, the third band-hole top side tab and the third band-hole top tab are depressed by the second band and positioned within the second band is a second produce article of said multiple of produce articles.

* * * * *